US005319824A

United States Patent [19]

Cook, III

[11] Patent Number: 5,319,824

[45] Date of Patent: Jun. 14, 1994

[54] TILE JOINT CLEANING BRUSH

[76] Inventor: Elbert E. Cook, III, 1010 Nutwood, Bowling Green, Ky. 42102-6412

[21] Appl. No.: 11,694

[22] Filed: Feb. 1, 1993

[51] Int. Cl.[5] ..... A46B 5/00; A47L 13/00

[52] U.S. Cl. ..... 15/160; 15/106; 15/144.1; 15/172

[58] Field of Search ..... 15/106, 143.1, 144.1, 15/144.4, 145, 146, 160, 166, 172, 210.5, 244.1; 81/489

[56] References Cited

U.S. PATENT DOCUMENTS

| | | | |
|---|---|---|---|
| 239,660 | 4/1881 | Hurlburt | 15/145 |
| 328,426 | 10/1885 | Nowlin | 15/166 |
| 467,046 | 1/1892 | Myers | 15/167.1 |
| 1,391,018 | 9/1921 | Sohnle | 15/146 |
| 1,697,756 | 1/1929 | Curran | 15/166 |
| 1,871,146 | 8/1932 | Bosler | 15/146 |
| 2,184,602 | 12/1939 | Miller | 15/144.1 |
| 3,444,576 | 5/1969 | Daane | 15/28 |
| 4,064,588 | 12/1977 | Cooper | 15/236 |
| 4,204,295 | 5/1980 | O'Connor | 15/209 |
| 4,586,211 | 5/1986 | Phillips | 15/49 C |

FOREIGN PATENT DOCUMENTS

| | | | |
|---|---|---|---|
| 431756 | 11/1911 | France | 15/114 |
| 556147 | 7/1923 | France | 15/143.1 |
| 304347 | 3/1955 | Switzerland | 15/160 |

*Primary Examiner*—Philip R. Coe
*Assistant Examiner*—Randall E. Chin
*Attorney, Agent, or Firm*—Cushman Darby & Cushman

[57] ABSTRACT

A title joint brush structure is provided with a sturdy, handle which can be used from a standing position, pivotable about a horizontal axis, through vertical, to two oblique extremes at which positive stops are provided. The brush structure includes a main brush for cleaning one band of the joint, and a laterally adjustably spaced auxiliary brush for simultaneously cleaning an adjoining band of the joint.

5 Claims, 3 Drawing Sheets

TILE JOINT CLEANING BRUSH

BACKGROUND OF THE INVENTION

Tile, and equivalent blocky panels used for providing the wear surfaces of floors and walls often are bedded in a cementitious and/or resinous layer of settable or otherwise hardenable material, with some spacing being provided between edges of adjoining panels, which provide exposed joints, in which the bedding material, or a screeded or flowed into place outward extension thereof, is exposed. The exposed outer surface of the joint material may be flush with the wear surfaces of the panels, or (more commonly) outwardly shallowly concave, or otherwise patterned.

The floors or walls may be located within a building, or wholly or partly outdoors.

Most commonly, such wear surfaces require cleaning at least once at the conclusion of the installation process. Depending on the location, cleaning may, from time to time, be thereafter necessary or desirable.

Especially when such surfaces are provided on floors, a common way to clean them is to spread a layer of cleaning solution on the floor, e.g., by pouring or spraying, to swab, scrub or burnish the surfaces using mops, scrubbing machines and/or buffers. While the techniques conventionally used may be quite adequate for efficiently cleaning the exposed surfaces of the tiles, brick or other panels per se, it has heretofore been difficult or impossible to efficiently clean the exposed surface of the joint material. It is not uncommon for the mechanized cleaning of the panel surfaces, to be accompanied by manual, on-hands-and-knees cleaning of the joint surface, using scrub-brushes, and even tooth brushes. Special tile grout cleaning tools have previously been devised by others, but they are designed for cleaning one band of joint surface at a time, and generally are meant to be used while the worker is down on hands and knees.

SUMMARY OF THE INVENTION

A tile joint brush structure is provided with a sturdy, handle which can be used from a standing position, pivotable about a horizontal axis, through vertical, to two oblique extremes at which positive stops are provided. The brush structure includes a main brush for cleaning one band of the joint, and a laterally adjustably spaced auxiliary brush for simultaneously cleaning an adjoining band of the joint.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
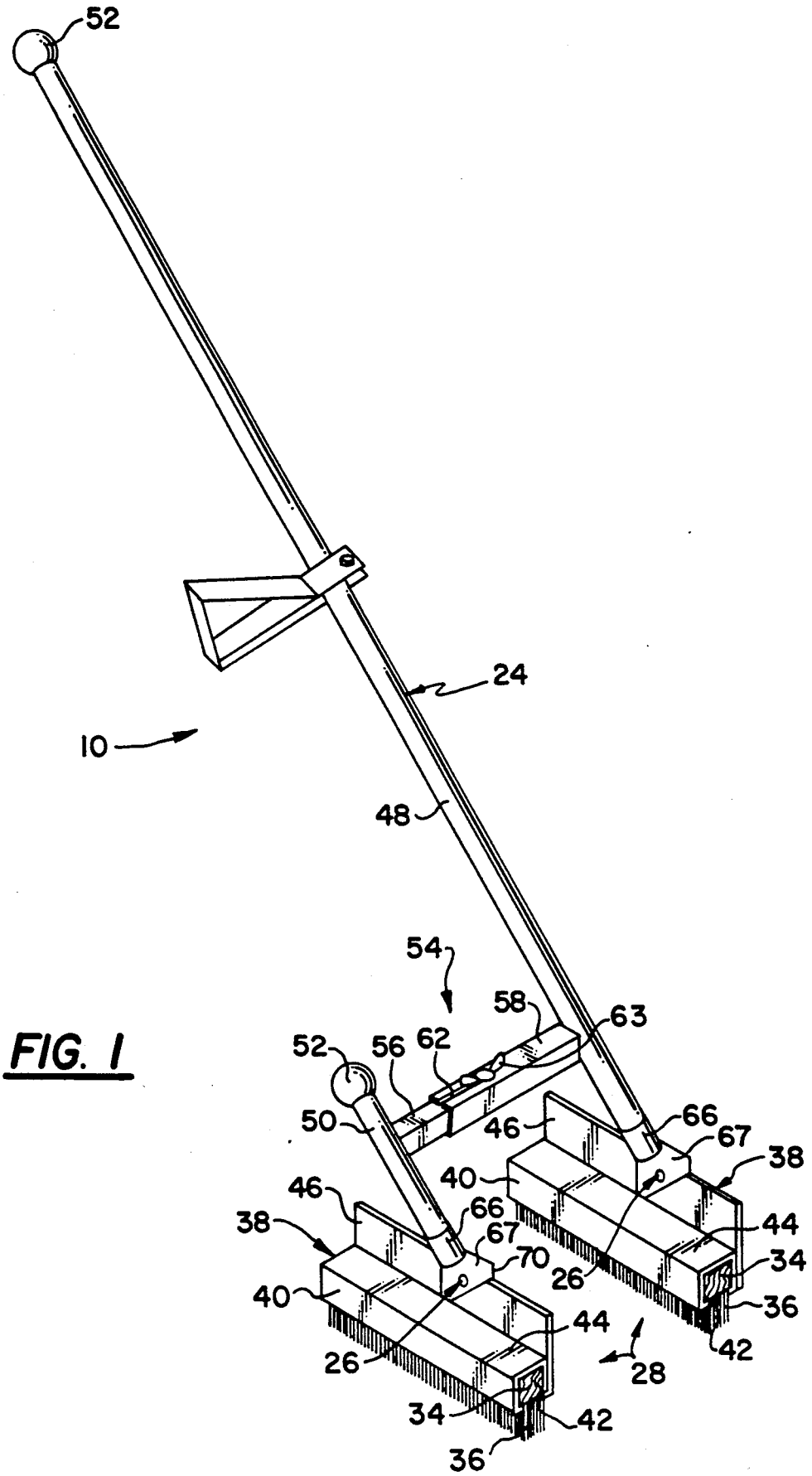
FIG. 1 is a perspective view from the front and top, showing a tile joint cleaning brush embodying principles of the present invention.

In the description, the term "tile" is used as a generic term equally to denote tile, brick and other blocky panel material having an exposed wear surface of a floor, or wall (also including a pool coping, a planter box, a patio, driveway, sidewalk and similar architectural features). The term "band" (of a joint) is used to denote the full width of a portion of the joint running in one direction between two laterally adjoining tiles (or rows or columns of tiles).

In the drawings, a tile joint cleaning brush embodying principles of the present invention is shown at 10. It is preferably made of materials customarily used for manufacturing industrial and household cleaning tools and implements such as mops, brooms, rakes, cultivators and handled brushes, although it is preferred that the handle portion of the tool be made of tubular steel, rather than of wood. (Conventionally, some of the tools and implements just mentioned have handles made of tubular steel, but others are made of wood, and so cannot stand the torque and bending force that may need to be applied for rapid, efficient and thorough cleaning of tile joints.)

Figure 2:
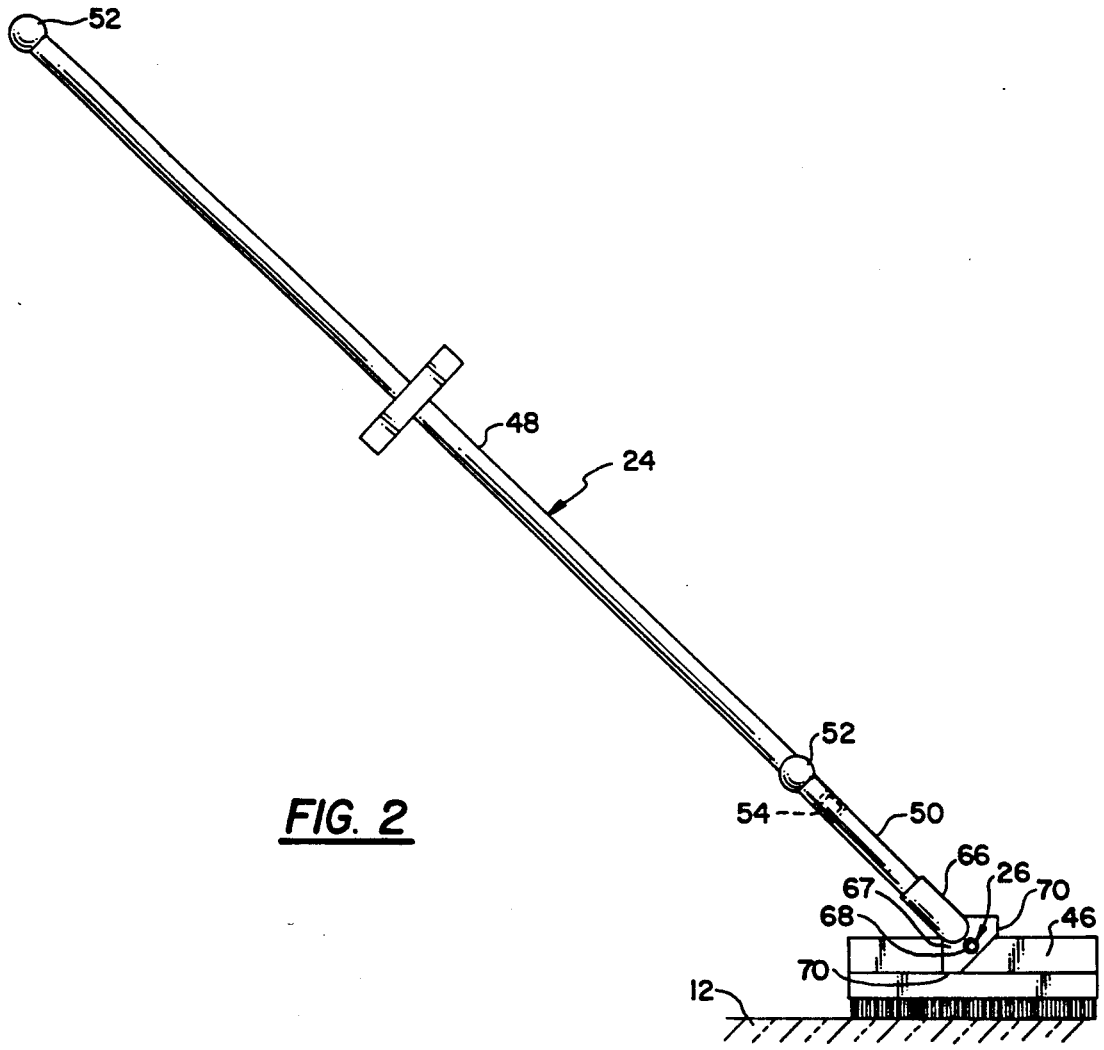
FIG. 2 is a top plan view thereof (with the handle structure rotated to the one extreme oblique position that is illustrated is FIG. 1)
Figure 3:
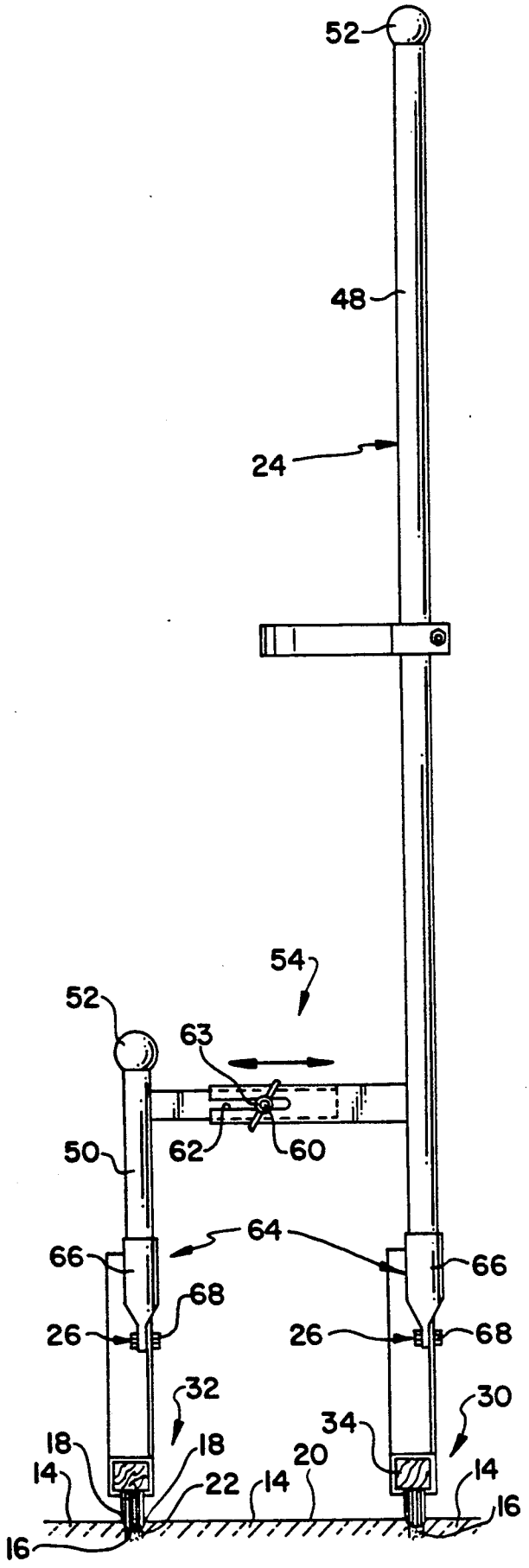
FIG. 3 is a side elevational view thereof, showing the side which is closest to the viewer in FIG. 1.

A tile structure is shown at 12 in FIGS. 2 and 3, which includes individual tile 14 set in rows or columns in a bed of hardened material which provides bands of joint 16 (or "joints"), between spaced edges 18 of adjoining tile. The tile have exposed wear surfaces 20, between which the joints have exposed surfaces 22 (which, in this instance, are shown being outwardly concave in transverse-cross-sectional profile).

The brush 10 includes a handle structure 24, which is pivotally joined (at 26) to a brush structure 28.

The brush structure 28 is shown including a main brush 30, and an auxiliary brush 32. One or more additional auxiliary brushes could be similarly provided.

Each brush 30, 32 is shown including a body 34 in which a set of bristles 36 is embedded so as to have free end portions protruding parallel to one another in a common direction. The length and width of each field of bristles is subject to choice, depending on the design of the joints which are to be cleaned. A typical set of bristle field dimensions is one-half inch (1.3 cm) wide by twelve inches (30.4 cm) long, with the exposed free end portions of the bristles typically being one inch (2.6 cm) long. The bristle stiffness is typical of that of floor scrub brushes such as are currently commonly available at janitorial supply companies and hardware stores. The bristle material may be natural or synthetic, e.g., made of the same natural or synthetic fibers as are conventionally used for making shop brooms, driveway brooms, roofing tar applicators and wall paper smoothing brushes.

Likewise, the bodies 34 may be made of conventional natural or synthetic material used for making push brooms, scrub brushes, roofing tar applicators and wallpaper smoothing brushes.

Each brush body 34 is seen being gripped in a holder 38 which includes a downwardly opening girdling channel 40, out through a longitudinal slot 42 of which the set of bristles 36 projects. By preference, the brush body 34 is removably secured in the holder 38 so that the brushes can be replaced without replacing the holders 38. However, the respective brush bodies and holders can be unitarily constructed, so as each to be replaceable as a unit, or the bristle sets 36 could be replaceably mounted in the brush bodies 34.

Each holder 38 is shown including a back flange 44 and (at right angles to the back flange 44), a mounting flange 46, in which the pivotal joint 26 is provided.

The brush structures 28 are, in use, disposed parallel to one another with their sets of bristles projecting in the same direction, to a common level, with spacing laterally between the bristle sets. By preference, the two brush structures are alike, or substantially alike, in structure and size. The two brush structures preferably are orthogonally arranged, so that their leading and trailing ends are respectively aligned transversally of the brush structure.

The handle structure 24 is shown including a main handle 48 which preferably is of the same length as that commonly used for implements meant to be pushed and pulled by a standing adult user, e.g., push brooms, garden hoes and floor mops.

The handle structure 24 further includes an auxiliary handle 50, which may be of the same or a similar length, but preferably is considerably shorter, e.g., one foot (30.4 cm) long.

Each of the handles is shown provided at its upper end with a palm grip 52 which may be in the form of a ball and be secured in place by any convenient means. For instance, it may be made of plastic material or rubber, and stabbed or screwed in place in the same way that crutch tips are conventionally socketed onto the ends of crutches. The grips 52 have two functions, namely, to provide a convenient structure to be grasped in a user's fist or socketed in the palm of their hand, and also to serve as a deflecting bumper to prevent gouging injury to walls, or to other structures or persons which may be accidentally struck or otherwise touched by the handle ends while the brush 10 is being used or stored.

The two handles 48, 50, at corresponding sites relative to their lower ends are provided with adjustable means 54 for rigidly interconnecting them so that the two handles are disposed parallel to one another, with their lower ends at a common level, and so that the two handles are spaced laterally apart by a selected distance.

In practice, that selected distance is one which disposes the sets of bristles 36 of the respective brush structures 28 to simultaneously clean the joints between two different pairs of adjoining rows of tiles 14.

The handle interconnection means 54 may have many different forms. In the presently preferred structure which is illustrated, the handle interconnection means 54 is shown including two transversally extending square tubes 56, 58 each having a respective end securely mounted on a respective handle, and a free end. The inner transverse dimensions of one of the square tubes is sized to telescopically slidingly receive a free end portion of the other of the square tubes. A projecting threaded post 60 on one side of the smaller, inner tube projects out through a slot 62 (or a row of holes) provided in a corresponding one side of the larger, outer tube, and a wing nut 63 is manually tightened in the post 60 after the tubes have been telescoped to a desired degree of relative extension, in order to adjustably fix the spacing of the two handles.

At its lower end, each handle 48, 50 is shown being provided with a bracket 64 which includes a socket portion 66 by which the lower end of the respective handle is secured to the respective bracket 64, and a vertically oriented spade-like flange 67.

The handles 48, 50 are mounted to the respective brush holders mounting flanges 46 at the respective pivotal joints 26, by any convenient means, e.g., nut and bolt assemblies (or rivets) 68, installed on transverse horizontal axes through aligned openings provided through the flanges 66 and 46.

By preference each flange 67 includes two edge portions 70 which are located to engage the back flanges 44, holder channels 40 of the respective brush bodies only when the handle structure has been tipped about the pivotal joints 26 to a comfortable oblique angle for a user to be applying pressure while pushing and pulling down on the brush structure using the handle structure. That angle is, for instance, 45°. Thus, the edge portions and back flanges 44 when engaged provide a positive stop against further tilting of the handle in the same direction.

The parts of the brush 10 may be protectively coated by being plated, painted or soaked with conventional coatings and/or preservatives.

Although by preference the two brush bodies are preferably spaced apart by adjustment of the handle interconnecting spacing adjustment means, by an amount equal to the space between two adjacent strips of tile joint (i.e., the width of one tile plus one joint, but, especially for work on narrow tiles, the spacing may be equal to that of a multiple of tile widths, such as two or three, plus the widths of intervening joint strips plus one).

The cleaning solution used may be conventional.

The main handle is shown provided at an intermediate location with an adjustably located and fixed loop-type handle 72 such as is conventionally found on most electrically powered rotary string trimmers used for cutting grass around the edges of flower beds and walkways.

In use, e.g., for cleaning the joints on a tile floor, a cleaning solution is spread on the floor and pushed around using mops and/or floor scrubbing machines. Then, the brush 10 is adjusted for proper brush spacing to match the spacing of the grout joints on the tile, and used to scrub the joints. Finally, the spent cleaning solution is mopped up and/or vacuumed up, and the floor is finished.

It should be noticed that, by preference, the flanges 46 are located laterally to one side of the brush bodies, so that the brush 10 can be used for cleaning all of the joints, even those which may be located at an extreme edge of a floor, where it meets a core molding or the base of a wall.

It should now be apparent that the tile joint cleaning brush as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A tile joint cleaning brush for simultaneously cleaning exposed joint surfaces between edges of wear surfaces of two neighboring rows of tile, comprising:

a brush structure including a main brush and an auxiliary brush, each including a brush body having a set of bristles embedded therein, said bristles having free end portions extending in a same direction from the respective said brush body, said main and auxiliary brushes being arranged parallel to one another and having said free ends disposed at a common level which defines a horizontal plane, two individual holders, each having a back flange from which a mounting flange projects, each brush body being mounted to a respective said holder;

a handle structure including a main handle and an auxiliary handle each having a respective longitudinal axis, at least one of said handles being of sufficient length to be manually used by an adult user for pressing the brush structure against a floor while standing; both handles having lower ends provided with mounting brackets; said handles being provided at corresponding positions above said common level, with a means for adjustably fixedly transversally, relative to said longitudinal axes, interconnecting said handles, said handles extending parallel to one another; said means for adjustably fixedly transversally interconnecting said handles being adjustable for providing said handle structure with a desired amount of handle-to-handle transverse spacing relative to said longitudinal axes for adapting the tile joint cleaning brush to use for simultaneously cleaning plural tile joints having different joint-to-joint spacings; and pivot joint means connecting said mounting brackets of said handle structure to said mounting flanges of said brush structure about a common axis which is transverse to said longitudinal axes whereby said handle structure is tiltable relative to said brush structure about said transverse axis.

2. The tile joint cleaning brush of claim 1, wherein;

said mounting brackets and mounting flanges are provided with positive stop means for engagement with one another upon tilting of said handle structure relative to said brush structure by a predetermined maximal amount about said transverse axis, for allowing a user to apply pushing force through said mounting brackets to said mounting flanges at a convenient angle.

3. The tile joint cleaning brush of claim 2, wherein:

said means for adjustably fixedly interconnecting said handles comprises a pair of square tubes each having one end based on a respective handle, and a free end portion; one said free end portion being telescopically received in said other free end portion, and fastener means being releasably tightened for fixing a selected degree of extension of one said square tube from the other of said square tubes.

4. The tile joint of claim 3, wherein:

on at least one of said brushes, the respective said set of bristles is substantially vertically aligned with the respective said mounting bracket, so that said tile joint cleaning brush is useful for cleaning a tile joint located adjacent an intersection of a floor and a base of a wall.

5. The tile joint cleaning brush of claim 1, wherein:

said means for adjustably fixedly interconnecting said handles comprises a pair of square tubes each having one end based on a respective handle, and a free end portion; one said free end portion being telescopically received in said other free end portion, and fastener means being releasably tightened for fixing a selected degree of extension of one said square tube from the other of said square tubes.

* * * * *